US008733567B1

(12) United States Patent
Dopps

(10) Patent No.: US 8,733,567 B1
(45) Date of Patent: May 27, 2014

(54) BOTTLE CAPPING ASSEMBLY

(71) Applicant: Daniel A. Dopps, Wichita, KS (US)

(72) Inventor: Daniel A. Dopps, Wichita, KS (US)

( * ) Notice: Subject to any disclaimer, the term of this patent is extended or adjusted under 35 U.S.C. 154(b) by 0 days.

(21) Appl. No.: 13/680,032

(22) Filed: Nov. 17, 2012

(51) Int. Cl.
*B65D 51/24* (2006.01)

(52) U.S. Cl.
USPC ..... 215/304; 220/254.3; 215/256; 215/258

(58) Field of Classification Search
USPC ..... 215/304, 303, 253, 256, 302, 258, 250, 215/305, 310; 220/290, 831, 832, 254.3, 220/258.2, 259.1, 744
See application file for complete search history.

(56) References Cited

U.S. PATENT DOCUMENTS

| | | | | | |
|---|---|---|---|---|---|
| 314,244 | A | * | 3/1885 | Henkel | 220/832 |
| 1,038,001 | A | * | 9/1912 | Schaffer | 220/379 |
| 1,410,250 | A | * | 3/1922 | Hentschel | 215/253 |
| 1,519,100 | A | * | 12/1924 | Allums | 215/304 |
| 1,520,845 | A | * | 12/1924 | Baker | 222/556 |
| 1,890,691 | A | * | 12/1932 | Mergentheim | 215/253 |
| 2,104,593 | A | * | 1/1938 | Nathe, Jr. | 222/528 |
| 2,184,215 | A | * | 12/1939 | Geyer | 222/528 |
| 2,213,200 | A | * | 9/1940 | Brainard | 222/528 |
| 2,276,577 | A | * | 3/1942 | Hahn | 229/123.3 |
| 2,738,090 | A | * | 3/1956 | Davis | 215/253 |
| 3,216,602 | A | * | 11/1965 | Koll | 215/254 |
| 3,407,957 | A | * | 10/1968 | Robinson | 215/251 |
| 3,931,904 | A | * | 1/1976 | Coop | 215/254 |
| 3,958,710 | A | * | 5/1976 | Harding et al. | 215/254 |
| 3,966,080 | A | * | 6/1976 | Bittel | 220/269 |
| 3,974,931 | A | * | 8/1976 | Moller | 215/254 |
| 3,981,412 | A | * | 9/1976 | Asmus | 220/270 |
| 4,073,399 | A | * | 2/1978 | Lewis | 215/254 |
| 4,256,233 | A | * | 3/1981 | Harding | 215/254 |
| 4,356,939 | A | * | 11/1982 | Fitte | 222/541.9 |
| 4,440,310 | A | * | 4/1984 | Heyn | 220/270 |
| 4,460,103 | A | * | 7/1984 | Rama et al. | 220/254.3 |
| RE31,869 | E | * | 4/1985 | Harding | 215/254 |
| 4,555,035 | A | * | 11/1985 | Davis | 215/215 |
| 4,738,373 | A | * | 4/1988 | DeParales | 220/254.3 |
| 4,760,931 | A | * | 8/1988 | Gach | 215/235 |
| 4,809,874 | A | | 3/1989 | Pehr | |
| 4,821,899 | A | | 4/1989 | Nycz et al. | |
| 4,949,865 | A | * | 8/1990 | Turner | 220/713 |
| 4,969,574 | A | * | 11/1990 | Shastal | 220/269 |
| 4,986,465 | A | * | 1/1991 | Jacobsson et al. | 229/123.3 |
| 5,085,331 | A | * | 2/1992 | Groya et al. | 215/245 |
| 5,133,486 | A | * | 7/1992 | Moore et al. | 222/541.9 |
| 5,145,085 | A | * | 9/1992 | Yost | 220/269 |
| 5,148,937 | A | * | 9/1992 | Huard | 220/278 |

(Continued)

FOREIGN PATENT DOCUMENTS

GB 2447661 9/2008

*Primary Examiner* — Fenn Mathew
*Assistant Examiner* — Christopher McKinley
(74) *Attorney, Agent, or Firm* — Kenneth H. Jack; Davis & Jack, L.L.C.

(57) ABSTRACT

A bottle capping assembly including a "C" member having an upper arm, a lower arm, a stem section extending between the upper and lower arms, and having a laterally opening concavity formed by the arms and stem; a ceiling member, the ceiling member incorporating the "C" member's lower arm; and a frangible channel incorporated operatively into the ceiling member, the frangible channel being adapted for, upon an application of an upward force to the "C" member's upper arm, segmenting the ceiling member to form a fluid outlet port; the assembly further including a cylindrical wall fixedly attached to and extending downwardly from the ceiling member.

4 Claims, 8 Drawing Sheets

(56) References Cited

U.S. PATENT DOCUMENTS

| | | | | | |
|---|---|---|---|---|---|
| 5,285,917 | A * | 2/1994 | Hoffmann | 220/212.5 |
| 5,415,312 | A * | 5/1995 | Mueller | 220/254.3 |
| 5,490,609 | A * | 2/1996 | Lane et al. | 220/712 |
| 5,577,626 | A * | 11/1996 | Henkel et al. | 215/237 |
| 5,582,314 | A | 12/1996 | Quinn et al. | |
| 5,636,771 | A * | 6/1997 | Gordon et al. | 222/541.5 |
| 5,735,426 | A * | 4/1998 | Babcock et al. | 220/258.2 |
| 5,810,207 | A * | 9/1998 | Hayashida | 222/153.07 |
| 5,894,950 | A | 4/1999 | Kick | |
| 6,016,931 | A * | 1/2000 | Ohmi et al. | 215/256 |
| 6,050,435 | A | 4/2000 | Bush et al. | |
| 6,264,051 | B1 * | 7/2001 | Reidenbach | 215/237 |
| 6,460,712 | B2 | 10/2002 | Smith et al. | |
| 6,510,971 | B1 | 1/2003 | Martin | |
| 6,631,820 | B2 | 10/2003 | Harrold et al. | |
| 6,793,101 | B2 * | 9/2004 | Shinozaki et al. | 222/153.02 |
| 6,981,607 | B2 | 1/2006 | Lown et al. | |
| D521,381 | S | 5/2006 | Hicks et al. | |
| 7,404,495 | B2 | 7/2008 | Keung | |
| 7,484,638 | B2 * | 2/2009 | Mazzarolo | 220/712 |
| 7,510,095 | B2 | 3/2009 | Comeau et al. | |
| 7,549,559 | B2 * | 6/2009 | Conroy et al. | 222/556 |
| 7,673,767 | B2 * | 3/2010 | Vovan | 220/212 |
| 7,686,182 | B1 | 3/2010 | Shukri | |
| 7,810,681 | B2 * | 10/2010 | Lohrman et al. | 222/541.9 |
| 7,832,579 | B2 * | 11/2010 | Lohrman et al. | 215/256 |
| 7,963,409 | B2 * | 6/2011 | McGeough et al. | 215/256 |
| 8,172,101 | B2 | 5/2012 | Giusti | |
| 8,317,050 | B2 * | 11/2012 | Hollis et al. | 220/254.3 |
| 8,365,940 | B2 * | 2/2013 | Frishman | 220/255 |
| 2002/0166835 | A1 | 11/2002 | Carter | |
| 2005/0109780 | A1 * | 5/2005 | Pendergrass et al. | 220/254.1 |
| 2005/0109782 | A1 | 5/2005 | Biesecker et al. | |
| 2006/0043091 | A1 * | 3/2006 | Pinelli et al. | 220/254.3 |
| 2007/0039915 | A1 * | 2/2007 | Jackel | 215/235 |
| 2007/0095845 | A1 * | 5/2007 | Auer | 220/713 |
| 2008/0073311 | A1 * | 3/2008 | Jelich et al. | 215/305 |
| 2008/0078763 | A1 * | 4/2008 | Auer | 220/254.3 |
| 2011/0056905 | A1 | 3/2011 | Kick | |
| 2011/0297689 | A1 | 12/2011 | Reed et al. | |
| 2012/0318798 | A1 * | 12/2012 | Domoy | 220/258.2 |

* cited by examiner

BOTTLE CAPPING ASSEMBLY

FIELD OF THE INVENTION

This invention relates to plastic bottles and bottle cap combinations. More particularly, this invention relates to such bottle and cap combinations in which the cap component and an upper ceiling portion of the cap component are adapted for performing separate bottle opening and closing functions.

BACKGROUND OF THE INVENTION

Consumer product plastic bottles such as disposable plastic water bottles are known to be equipped with a plastic cap which includes an upper ceiling portion, a cylindrical side wall portion, and internal helical side wall threads for receiving and threadedly engaging external helical threads extending about the bottle's neck. In many instances, a user of such common plastic bottle and plastic cap combination will remove the bottle's cap while intending to totally consume the bottle's liquid contents without any recapping or reclosing of the bottle. In such circumstances, such user understands that the need for the cap's performance of its bottle closing and liquid retaining function has ended. Such circumstances and understanding often lead to the user's immediate disposal of the cap. While the user's subsequent disposal of the plastic bottle typically is properly directed to a recyclable plastics bin, the user's earlier disposal of the bottle's plastic cap is less often directed to recycling, and such caps are often improperly disposed of, becoming ground and water polluting litter.

The instant inventive bottle capping assembly solves or ameliorates the above discussed problems, defects, and deficiencies of common bottle and cap assemblies, while retaining substantially all of those components' normal functionality, by providing a specially configured cap which is capable of symbiotically performing a bottle neck and bottle lip actuated port opening function at the cap's ceiling.

BRIEF SUMMARY OF THE INVENTION

A first structural component of the instant inventive bottle capping assembly comprises a "C" member having an upper arm, a lower arm, a stem section extending between the upper and lower arms, and having a normally laterally opening concavity, such concavity comprising the hollow portion of the "C". In the preferred embodiment, the invention's "C" member is composed of plastic and is formed wholly with other portions of the cap component of inventive assembly.

A further structural component of the instant inventive bottle capping assembly comprises a ceiling member, such member comprising the "C" member's lower arm.

Further structural components of the instant inventive bottle capping assembly comprise opening means which are connected operatively to the ceiling member. In the preferred embodiment, the opening means are adapted for, upon an application of an upwardly directed force to the "C" member's upper arm, opening and segmenting or porting the ceiling member. The segmenting of the ceiling preferably occurs at and about the "C" member's lower arm. Suitably, such segmenting may alternatively occur at or about the "C" member's stem section, or at or about the upper end of the stem section.

In a preferred embodiment, the assembly's opening means comprises a port or opening lining channel, such channel including or defining a frangible or breakable channel floor.

Suitably, the opening means may alternatively comprise a snap channel and snap ridge joint or an adhesively bonded joint.

A further structural component of the instant inventive bottle capping assembly comprises a cylindrical wall which is fixedly attached to or formed wholly with the ceiling member, such wall extending downwardly from the ceiling member's periphery. In a preferred embodiment, the wall is internally helically threaded for threaded engagement with matching external helical threads extending about the neck of a common plastic bottle.

In use of the instant inventive bottle capping assembly, and assuming that the cap component covers a bottle containing a fluid such as water or a soft drink beverage, and further assuming that the opening means comprise the preferred channel and frangible channel floor combination, a user may manually apply an upwardly directed force against a distal end of the "C" member's upper arm, such force causing such arm to segment and open the cap's ceiling at and along the ceiling's frangible channel floor. Preferably, the ceiling is further specially configured and adapted for symbiotically utilizing the neck and lip of the bottle as a readily available levering tool for the exertion of such upwardly directed force.

Upon opening of the cap's ceiling via upward biasing against the assembly's "C" member arm, the user may reattach the cap and may drink from the bottle while the cap remains screwed onto the bottle. Upon completion of drinking, the entire bottle and cap assembly may be disposed of as a single unit. The instant invention advantageously obviates and avoids the user's earlier permanent removal of and potentially improper separate disposal of the cap component.

Accordingly, objects of the instant invention include the provision of a bottle capping assembly which incorporates components, as described above, and which arranges those components in relation to each other in manners described above, for the achievement of the above described objects and benefits.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENTS

Figure 1:
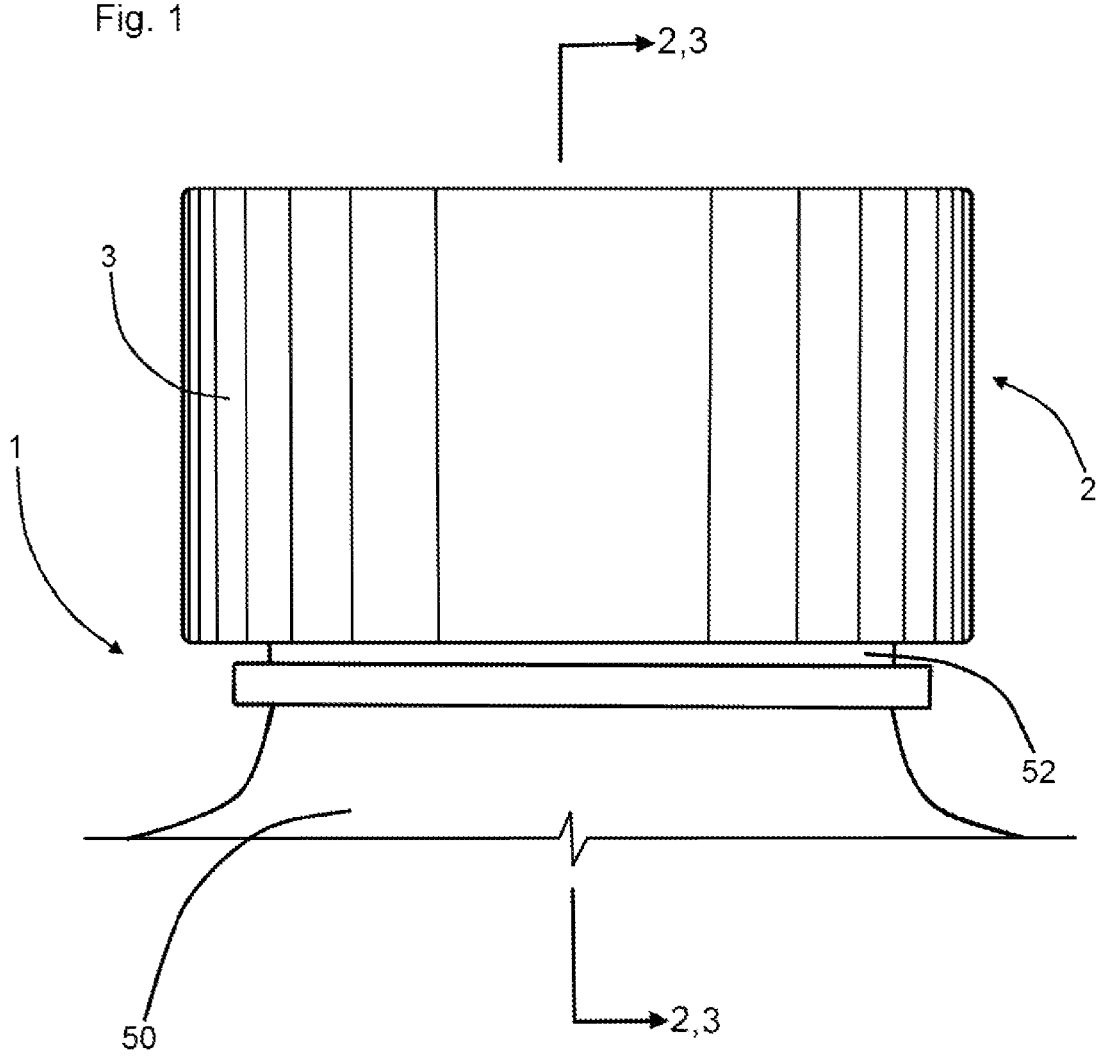
FIG. 1 is a partial side view of a preferred embodiment of the instant inventive bottle capping assembly.
Figure 3:
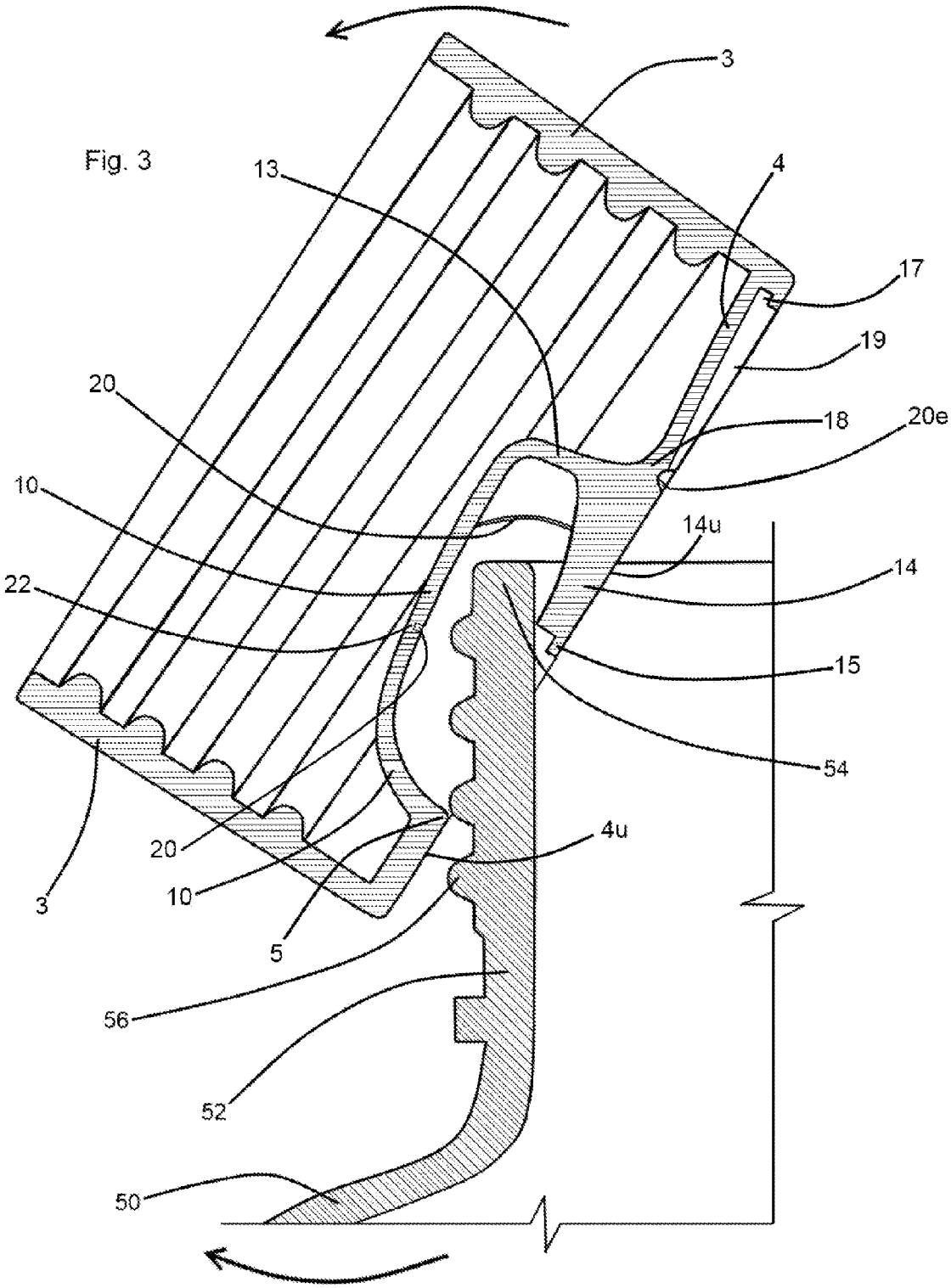
FIG. 3 redepicts the structure of the sectional view of FIG. 2, the view of FIG. 3 showing the assembly's cap portion in levering engagement with the assembly's bottle neck and lip components.

Referring now to the drawings and in particular to Drawing FIG. 1, a preferred embodiment of the instant inventive bottle capping assembly is referred to generally by Reference Arrow 1. The assembly 1 preferably comprises a lower bottle component which is identified generally by Reference Numeral 50. Bottle 50 preferably contains water or a soft drink beverage (not shown within views). Referring further simultaneously to FIG. 3, the bottle 50 has an upwardly extending neck portion 52, external helical threads 56 for facilitating a bottle cap screw on/screw off function, and a circular upper lip 54.

Figure 2:
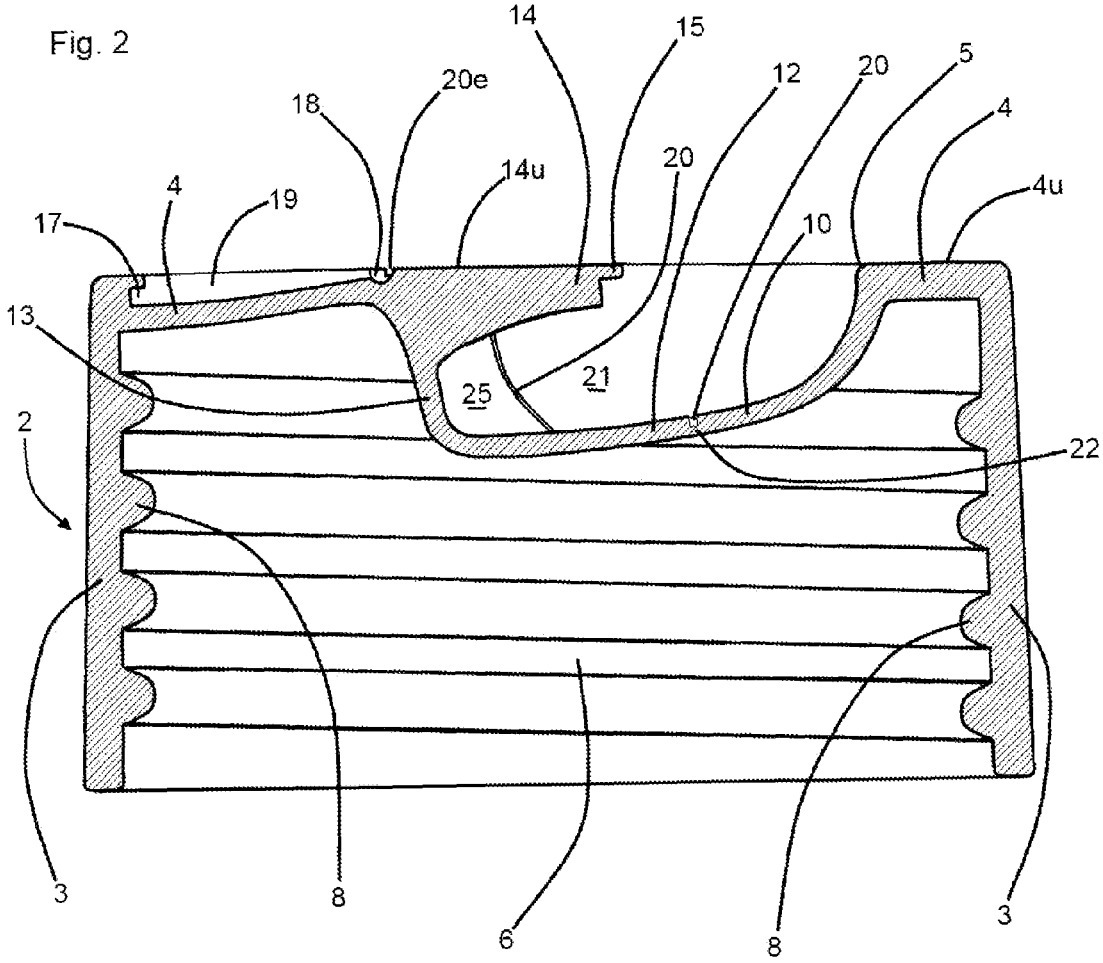
FIG. 2 is a sectional view as indicated in FIG. 1, the view of FIG. 2 showing the assembly's cap component temporarily separated from the plastic bottle component.

Referring to FIGS. 1 and 2, a cap component of the instant inventive assembly 1 is referred to generally by Reference Arrow 2. The cap 2 preferably comprises a ceiling 4 having an upwardly opening concavity 21, and a cylindrical side wall 3 which extends downwardly from, and is preferably formed wholly with the circular periphery of the ceiling 4. The ceiling 4 in combination with side wall 3 defines a downwardly opening bottle neck and lip receiving concavity 6, the side wall 3 presenting internal helical threads 8 which are, referring further simultaneously to FIG. 3, fitted for threaded engagement with helical threads 56 of bottle neck 52.

Referring to FIG. 2, a "C" member subcomponent of the instant inventive assembly comprises an upper arm 14, a lower arm 12, and a stem section 13. The "C" member's upper and lower arms 14,10,12 in combination with the stem section 13 form and define a normally laterally opening bottle lip receiving concavity 25 whose function is further discussed below. In the preferred embodiment of the instant inventive assembly, the cap's ceiling 4 comprises the "C" member's lower arm 10,12, such arm normally serving as an integral part of the floor of the ceiling's upwardly opening concavity 21.

The instant inventive bottle capping assembly preferably further comprises opening means which are connected operatively to the ceiling member 4. Referring to FIGS. 2-6, the opening means are preferably configured as a combination of a channel 20 and an underlying thinned or reduced thickness channel floor section 22, such reduced thickness making the channel floor 22 frangible. Suitably, the depicted relative over/under orientation of the channel 20 and frangible floor 22 may be reversed. Upon application of an upwardly directed force to the "C" member's upper arm 14, such force is transmitted to the "C" member's stem 13, such force at least causing the "C" member's upper arm 14 to pivot about a living hinge 18, and such force is instantaneously exerted against the ceiling 4 at the locus of the channel 20 and channel floor 22. Such stress causes the ceiling 4 to separate or segment along channel 20. Shearing of the ceiling 4 along channel 20 advantageously creates an opening or port 11.

Figure 4:
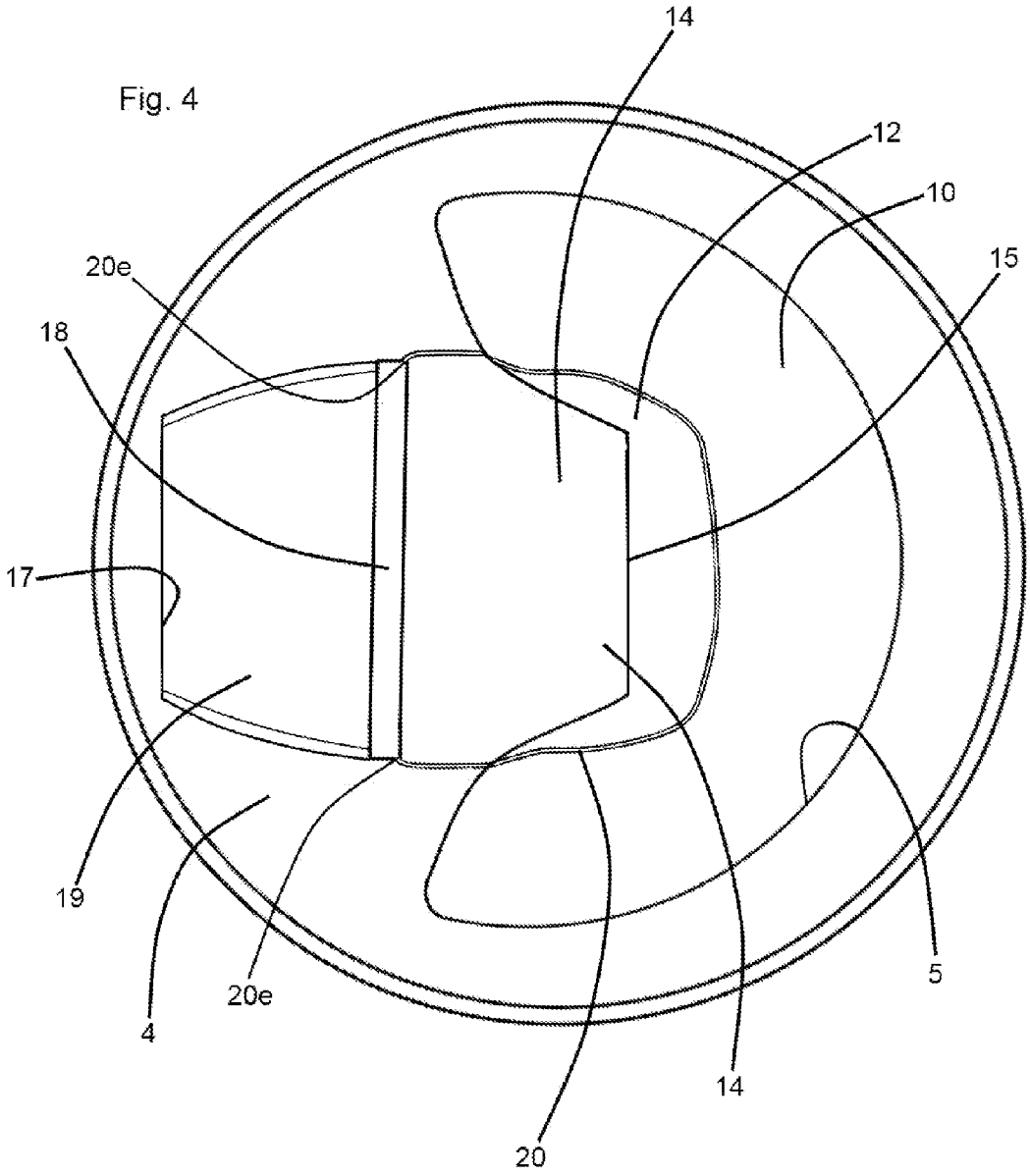
FIG. 4 is an upper view of the structure depicted in FIG. 2.
Figure 6:
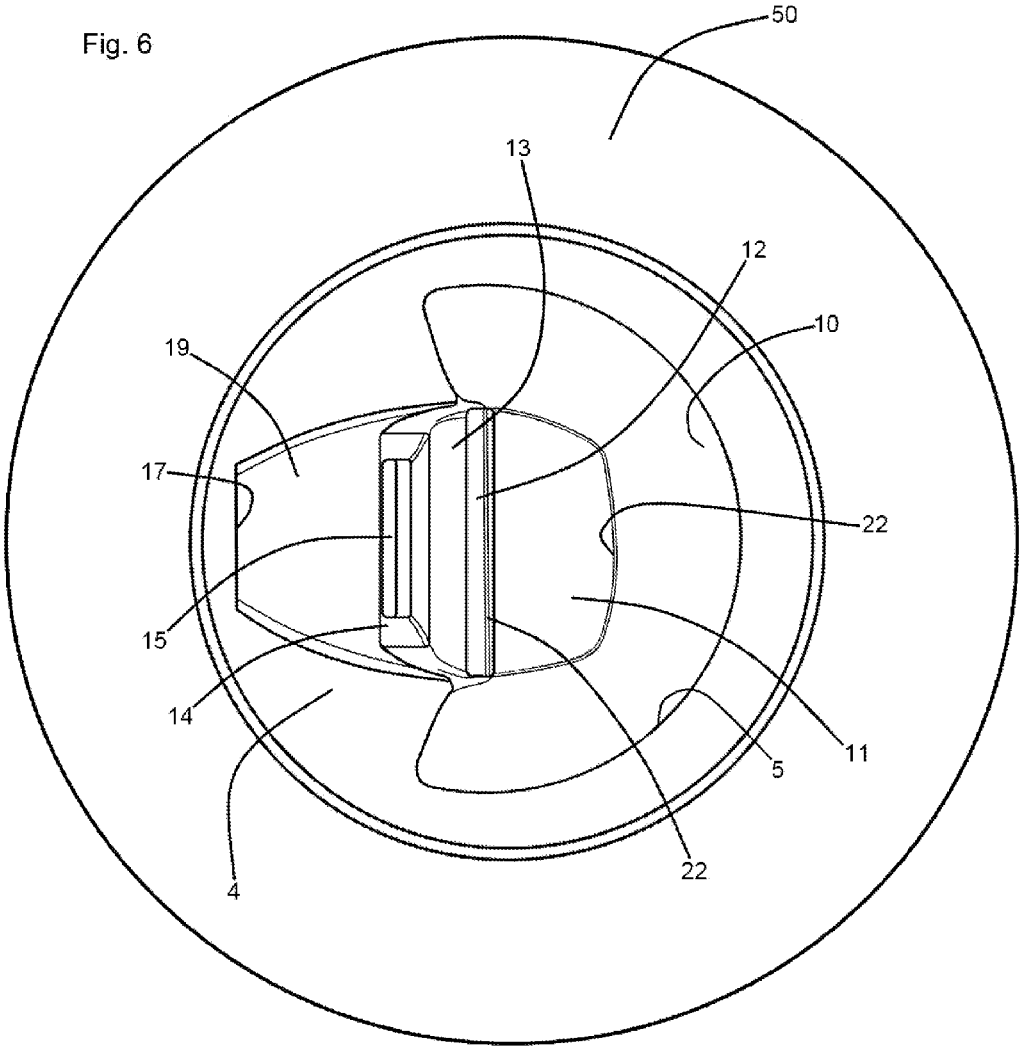
FIG. 6 is an upper view of the structure of FIG. 5.

Referring to FIGS. 2, 4, and 6, the opening means' channel 20 preferably has a pair of channel ends 20*e* which open at opposite ends of the ceiling's living hinge 18. The pivoting movement of the "C" member's upper arm 14 from the normally closed position depicted in FIG. 2, toward the opened position depicted in FIG. 6 advantageously ports the ceiling 4 to allow the outward passage of fluid through opening 11. The channel 20 and frangible floor 22 opening means which is depicted in FIGS. 2, 3, and 4, is intended as being representative of other suitably and alternatively, though less desirably, utilized opening means such as adhesively bonded joints and snap ridge and snap channel joints.

Figure 7:
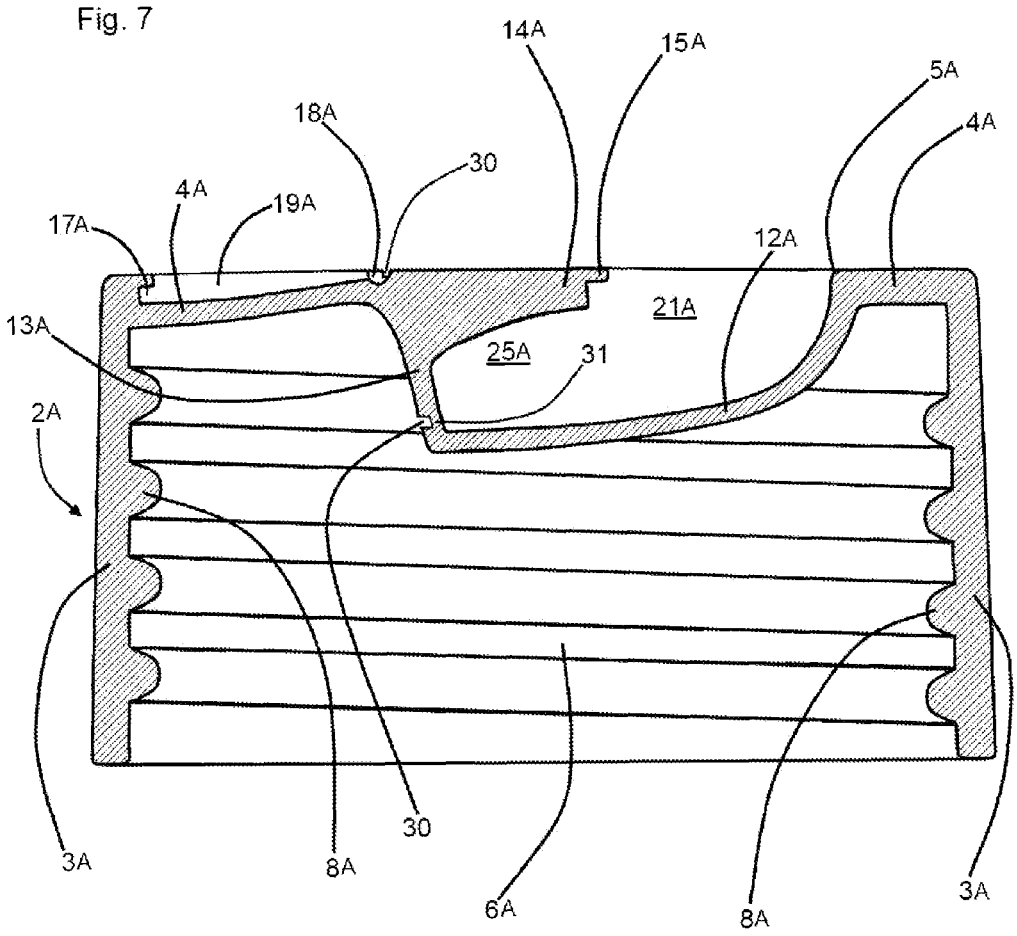
FIG. 7 depicts an alternative configuration of the structure depicted in FIG. 2.
Figure 8:
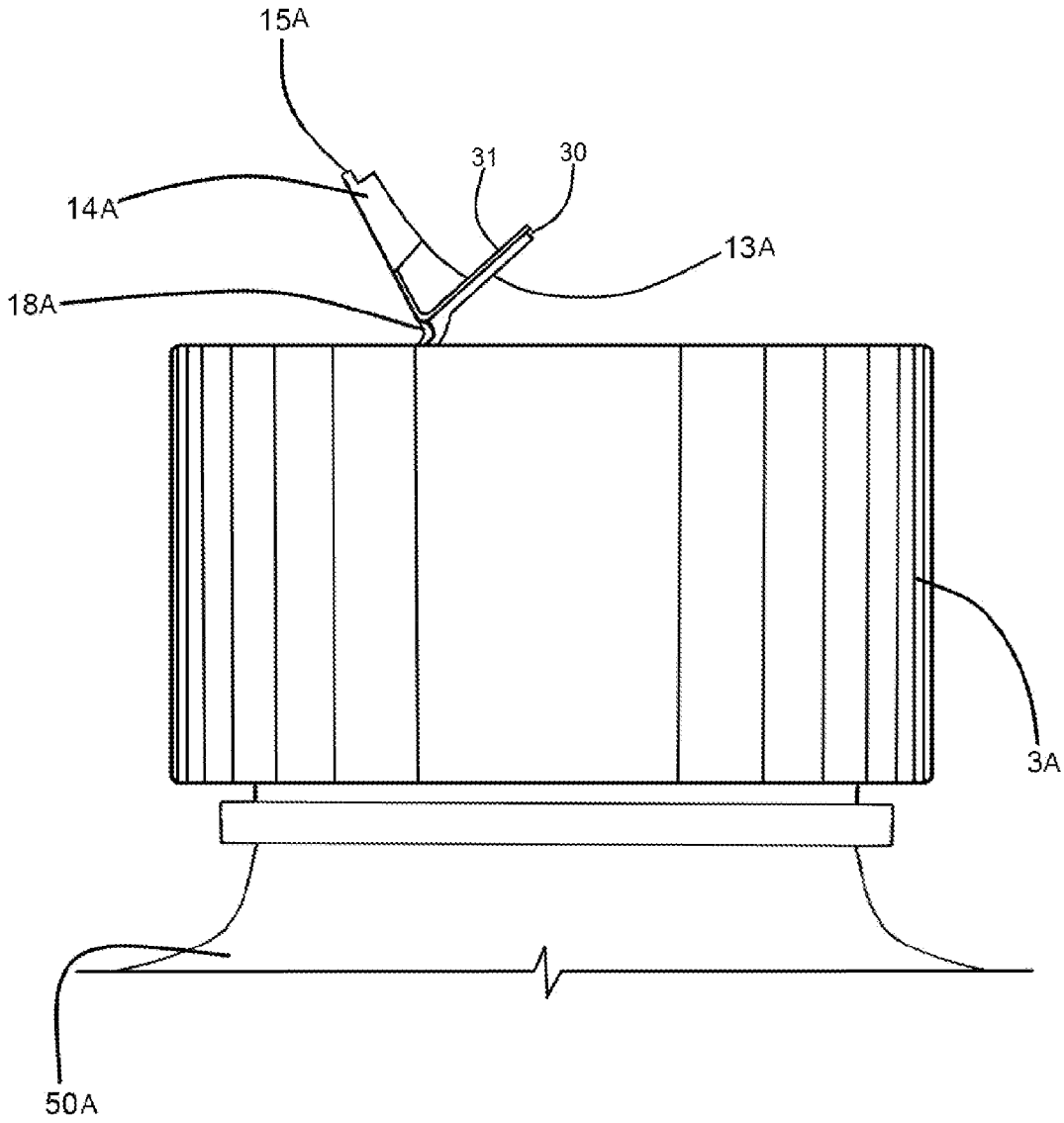
FIG. 8 depicts an alternative configuration of the structure depicted in FIG. 5.

Referring to FIGS. 7 and 8, all reference numerals having the suffix "A" are configured substantially identically with similarly numbered structures appearing in FIGS. 1-6. In the alternative configuration of FIGS. 7 and 8, the frangible channel configured opening means 30,31 is alternatively positioned at the base of the "C" member's stem 13 rather than at the "C" member floor lower arm 10,12 positioning which is represented by FIGS. 1-6. Upon operation of the opening means of FIGS. 7 and 8, the ceiling 4 becomes ported or opened at a more vertically oriented aperture bounded by the living hinge 18A and the lower end of the "C" member's stem 13A. Provided that the living hinge 18A is oppositely laterally positioned with respect to the upper end of the "C" member's stem 13A, the preferred channel and frangible channel floor combination opening means may suitably be further alternatively positioned at the upper end of the "C" member's stem section 13A. Upon such alternative configuration, the opening of the resultant port faces upwardly and resides between such differently positioned living hinge and the "C" member stem upper end.

Referring to FIG. 2, the ceiling 4 of the cap component 2 is, as is noted above, preferably specially configured to present an upwardly opening concavity 21. Upon positioning of the "C" member's arm 14 at the closed position represented by FIG. 2, upper arm surface 14*u* and upper ceiling surface 4*u* preferably assume a substantially co-planar orientation with respect to each other, such orientation advantageously allowing cased groupings of the inventive cap and bottle assembly to be stored in a vertically stacked arrangement without any undesirable protrusions of underlying cap structures into undersurfaces packaging of overlying bottles (not depicted within views).

Referring simultaneously to FIGS. 2, 3, and 6, it may be seen that the wall of concavity 21 and upper end or transition 5 of the concavity 21 are substantially circularly formed. Such preferred circular configuration of structures of the cap 2 advantageously compliment the circular cylindrical shapes of the neck 52 and upper lip 54 of the bottle 50. Such complimenting circular geometry allows, for purposes discussed below, insertions of the bottle neck 52 and bottle's lip 54 into concavities 21 and 25 in the manner indicated in FIG. 3.

Referring to FIGS. 1-6, in use of the instant inventive assembly 1 and assuming that bottle 50 is filled with water or a soft drink (not depicted within views), a user may initially grasp bottle 50 with one hand and may grasp cap 2 with his or her other hand. Thereafter, the user may turn cap 2 counterclockwise with respect to bottle 50, temporarily unscrewing and removing the cap 2 from the bottle 50. Thereafter, the user may partially invert the cap 2 to assume the upwardly angled position depicted in FIG. 3. Thereafter, the user may lower the cap 2 over a side portion of the bottle's neck 52 and over a corresponding portion of the bottle's upper lip 54, such lowering action causing the lip portion 54 to initially enter the cap's upwardly opening concavity 21 and to finally enter the laterally opening concavity 25 of the "C" member. Thereafter, upon engaging positioning of the cap 2 and bottle 50 in the manner depicted in FIG. 3, the user may firmly hold both the cap 2 and the bottle 50 in opposite hands while counter-turning those components against each other in the directions indicated by upper and lower curved arrows drawn upon FIG. 3. Such counter-turning forces applied to the cap 2 and to the bottle 50 advantageously allow the curved upper transition 5 of the concavity 21 to function as a fulcrum which causes the upward extension of the bottle's neck 52 and the lip 54 to contact and to forcefully lever against the "C" member's upper arm 14. Such levering action directs a cap opening force against the upper arm 14 of the "C" member, the force advantageously tearing or shearing the ceiling 4 along the channel and frangible floor 20,22 opening means. Upon performance of such lever actuated cap opening function, the "C" member's upper arm 14 advantageously pivots about living hinge 18 from the closed position depicted in FIG. 2 to the upwardly angled and opened position depicted in FIGS. 5 and 6.

The functions described above, along with their facilitating structures, create a symbiotic relationship between the bottle 50 and the cap 2 components of the instant invention, the symbiosis comprising the bottle's service as a cap opening tool and the cap's service as a bottle opening and closing tool. Such symbiotic relationship assures that the channel and frangible channel floor 20,22 opening means may strongly initially close the ceiling (preventing any premature or unintended opening of the cap), and further assures that a tool (i.e., the neck and lip of bottle 50) which is capable of breaking such closure will be readily available to the consumer.

Figure 5:
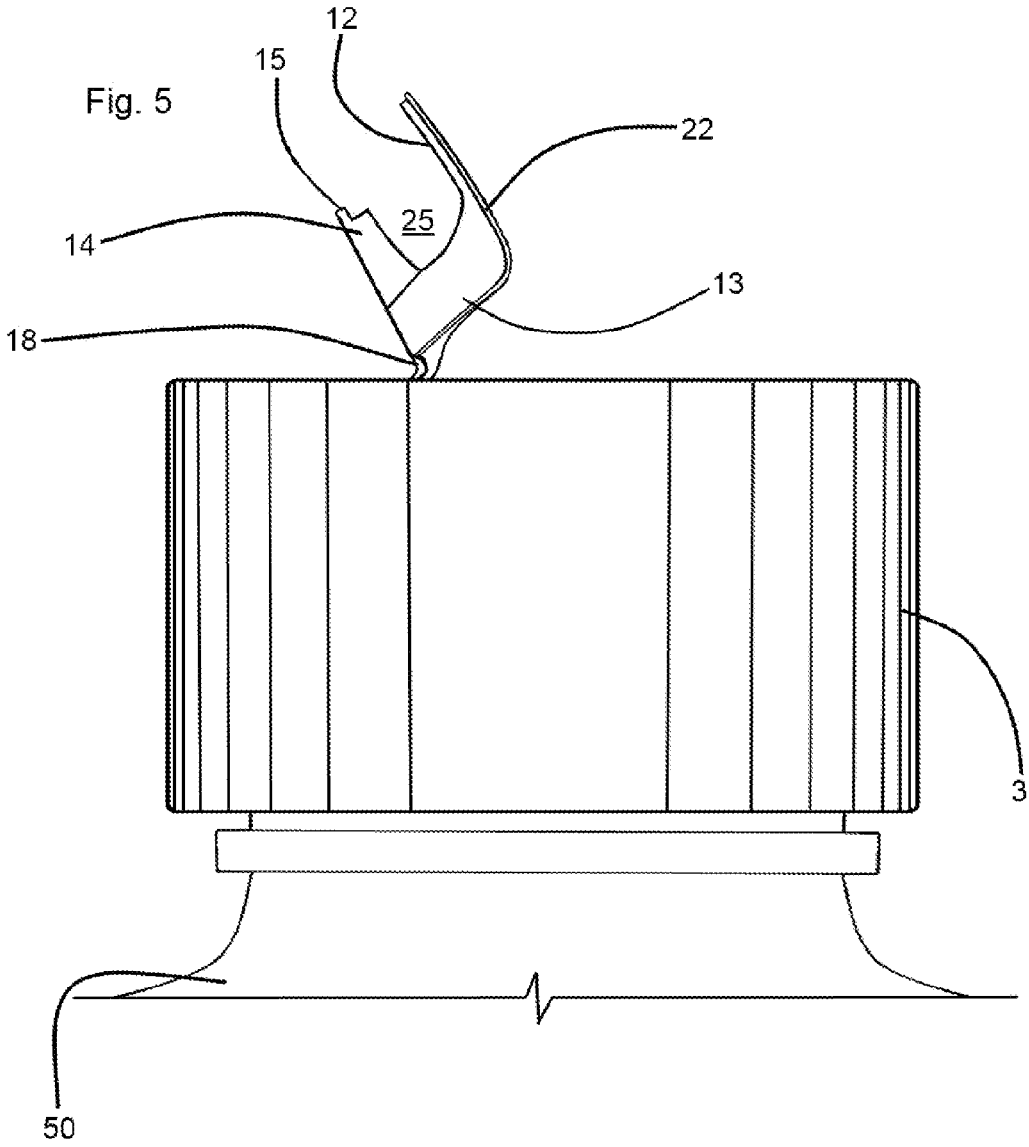
FIG. 5 redepicts the structure of FIG. 1, the view of FIG. 5 showing upper arm component of the assembly's "C" member upwardly and oppositely laterally pivoted to a ceiling opening or porting position.

Referring simultaneously to FIGS. 2, 5, and 6, it may be seen that plastic memory existing within the living hinge 18 will normally tend to move the "C" member's arm 14 from the opened position depicted in FIG. 5 toward the closed position depicted in FIG. 2, such normal closing bias potentially undesirably interfering with outward passage of fluid through port 11. Accordingly, the ceiling 4 is preferably further specially configured to include holding means which, upon further pivoting of the "C" member's arm 14 toward an oppositely laterally extended position, may hold such arm at an such position. In a preferred embodiment, the holding means comprise the molded formation of an upwardly opening tab clearance concavity 19 within the ceiling 4, in combination with formation of a snap ridge 15 and snap channel 17 fastener. Upon full oppositely lateral pivoting of the "C" member's arm 14 about living hinge 18, the ridge 15 situated at the distal end of the "C" member's upper arm 14 may snap into and nest within channel 17 which is formed at the upper end of the oppositely lateral wall of concavity 19. Preferably, the ridge 15 and channel 17 snap fastener structures are sized in relation to each other to allow finger pressure directed laterally against the upwardly extended ceiling structures to disengage the upper arm 14 from channel 17, such finger pressure then counter-pivoting the "C" member's arm 14 in the lateral direction to cause re-closure of opening 11. Upon such counter-pivoting motion, frictional contacts between the plastically deformed and torn surfaces of the frangible channel floor 22 advantageously maintain the cap in a re-closed configuration.

The holding means 15,17,19, depicted in FIGS. 2-6 is intended as being representative of other structures which may be suitably substituted for holding "C" member's arm 14 at the oppositely laterally extended position and for resisting lateral movement toward the closed position, such other structures including over-center biasing hinges, snap lug and snap socket combinations, adhesive contacts, and hook and slot fasteners.

Subsequent to a user's utilization of the bottle neck 52 and lip 54 for opening the cap 2, the user may screw the cap 2 back onto the bottle 50, and the user may advantageously drink from the bottle via passage of fluid through the port or opening 11. The instant inventive assembly 1 advantageously configures the bottle 50 and cap 2 as components which are compatible with fluid consumption while the cap is screwed in place. Upon completion of consumption of the fluid within the bottle, both the bottle 50 and the cap 2 may be properly disposed of as a single unit within a plastic waste recycling bin. Accordingly, the instant inventive assembly reduces occurrences of separate disposals of plastic caps, reduces littering disposals of plastic caps, and advantageously promotes recycling of plastic caps.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A bottle capping assembly comprising:

(a) a "C" member having an upper arm, a lower arm, and a stem section extending between the upper and lower arms, said arms and stem defining a laterally opening concavity;

(b) a ceiling member comprising an upwardly opening concavity and comprising the "C" member's lower arm and a living hinge;

(c) opening means comprising a channel and frangible channel floor combination, the opening means being connected operatively to the ceiling member, the opening means being adapted for, upon an application of an upward force to the "C" member's upper arm, porting the ceiling member;

(d) a wall fixedly attached to and extending downwardly from the ceiling member, wherein the living hinge has a pair of ends and wherein the channel and frangible channel floor combination has a pair of ends, said combination's ends being positioned at the hinge's ends, the living hinge being adapted for facilitating movements of the "C" member's upper arm between closed and opened positions, at least a portion of the "C" member overlying the ceiling member's port upon movement of the "C" member's upper arm to the opened position, and the port closing upon movement of the "C" member's upper arm to the closed position; and (e) a bottle having a neck, the neck having a circular lip, the wall being circularly fitted for nestingly receiving the circular lip, the ceiling's upwardly opening concavity being circularly fitted for alternatively nestingly receiving a portion of the circular lip, and the "C" member's laterally opening concavity being fitted for further alternatively nestingly receiving the portion of the circular lip, wherein the ceiling member further comprises a transition extending about the upwardly opening concavities' upper end, the transition being adapted for, upon the nesting receipt by the "C" member's laterally opening concavity of the circular lip portion, functioning as a fulcrum for transferring torque from the neck to the circular lip portion and to the "C" member's upper arm.

2. The bottle capping assembly of claim 1 wherein the living hinge is further adapted for facilitating movement of the "C" member's upper arm to an oppositely laterally extending position, and further comprising holding means connected operatively to the ceiling member, the holding means being adapted for, upon the movement of the "C" member's upper arm to the oppositely laterally extending position, resisting movement of the "C" member's upper arm toward the closed position.

3. The bottle capping assembly of claim 2 wherein the holding means comprise a snap ridge and snap channel combination.

4. The bottle capping assembly of claim 1 wherein each member among the ceiling and upper arm members has an upper surface, said surfaces being, upon the movement of the "C" member's upper arm to the closed position, substantially co-planar with each other.

* * * * *